United States Patent [19]

Aaroe

[11] 4,372,186

[45] Feb. 8, 1983

[54] HUMBUCKING ELECTROMAGNETIC PICKUP FOR STRINGED MUSICAL INSTRUMENTS

[76] Inventor: Kenneth T. Aaroe, 2276 John Ct., Castro Valley, Calif. 94546

[21] Appl. No.: 235,004

[22] Filed: Feb. 17, 1981

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS 3,915,048 10/1975 Stich ..... 84/1.15 X 4,220,069 9/1980 Fender ..... 84/1.15

*Primary Examiner*—Stanley J. Witkowski

*Attorney, Agent, or Firm*—Linval B. Castle

[57] ABSTRACT

A humbucking electromagnetic pickup for musical instruments, such as guitars having ferromagnetic strings. The pickup includes a permanent magnet for generating a flux path through the strings, a sensing coil in the flux path, and a humbucking coil substantially out of the flux path and concentrically wound closely around the periphery of the sensing coil and in opposition thereto to cancel radiating extraneous interfering electromagnetic hum from the sensing coil.

15 Claims, 11 Drawing Figures

HUMBUCKING ELECTROMAGNETIC PICKUP FOR STRINGED MUSICAL INSTRUMENTS

CROSS-REFERENCE TO RELATED APPLICATIONS

This application is for a humbucking improvement of my copending application, Ser. No. 226,406, filed January 1981, for a non-humbucking electromagnetic pickup.

BACKGROUND OF THE INVENTION

This invention relates to electromagnetic transducers and particularly to a novel and improved humbucking pickup for stringed instruments such as guitars or the like having ferromagnetic strings.

Electromagnetic pickups function by introducing a magnetic flux path to the metallic strings of the musical instrument and sensing the flux variation produced by string vibrations with a sensing coil also located in the flux path. In most instances, the sensing coils are wound around an array of small cylindrical permanent magnets or magnetic pole pieces, one underlying each of the instrument strings for directing the flux to its respective string.

Unfortunately sensing coils of such pickups are sensitive to interference caused by radiating electromagnetic generating sources such as fluorescent fixtures, transformers, motors, or the like, so that the sensing coils will generate a very disturbing hum signal at a frequency corresponding to the operating frequency of the radiating sources. This problem has led to the development of many types and designs of the so-called humbucking pickups, such as outlined and described in U.S. Pat. No. 4,220,069. In general, all such humbucking pickups comprise at least two identical, conventional or non-humbucking pickups in spaced, parallel locations beneath the instrument strings. The polarity of the flux-producing permanent magnet in each pickup is generally reversed from that in its adjacent pickup and the sensing coils are connected to that signals derived from variations in the flux through the instrument strings are additive in each of the spaced pickups, while signals from extraneous electromagnetic sources are subtractive and tend to buck and cancel the hum voltage generated in the adjacent pickup coil.

Humbucking pickups of this type are usually very sensitive to flux variations due to string vibrations and are also very effective at canceling or bucking out the undesirable hum signals providing that the source of such interfering radiation is at a point substantially normal to the plane of the instrument strings so that the A.C. hum is induced substantially equally in each of the identical sensing coils of the spaced parallel pickups. Coils of the type used for pickup sensing function in a manner similar to direction finders or loop antennae and any imbalance between the two side legs of one coil, or the output of the conventional humbucking configuration of two coils wound in opposition, will result in an A.C. hum output signal which is most undesirable in music pickups.

BRIEF DESCRIPTION OF THE INVENTION

In order to avoid the problem introduced by the loop antenna effect, it is apparent that the two identical opposed-wound or out-of-phase windings should be minimally spaced or even coaxial. It is obvious that all extraneous interference will be totally canceled if the two oppositely wound sensing coils in a humbucking pickup were wound together; however, it is also obvious that such a bifilar winding would also totally cancel the desired signals generated from the string flux path. My invention approaches this ideal situation and generates hum-free output signals of unusually high quality and very good intensity over a very wide frequency range.

Briefly, the humbucking pickup of the invention employs a single coil wound in two oppositely wound and concentric sections. This coil may therefore be considered as two elongated closely spaced concentric coils that are coplanar around a central vertical plane and coplanar to a horizontal plane parallel to the plane of the instrument strings. The concentric coils are obviously not identical. The center coil, referred to as the sensing coil, is in the string flux path to generate signals in response to the string vibrations while the outer coil, which is connected in series opposition, or out-of-phase with the inner coil and is referred to as the humbucking coil, functions primarily to cancel or buck out all undesirable extraneous radiation induced in the inner coil but also may respond to some of the magnetic flux to reinforce the signal from the center sensing coil. An additional advantage to the closely spaced, concentric, oppositely wound sensing and humbucking coils is that the peripheral humbucking coil acts to reduce the inductance and "Q" of the sensing coil so that the response of the pickup is quite flat over a wide frequency range and it is not over-sensitive at resonance. The commercially available flexible or rubber magnet produces the flux path which may be directed through pole pieces to the instrument strings. In one embodiment of the invention, the flux-conducting pole pieces are eliminated to further decrease the coil impedance and "Q" and to thereby materially increase the sensing coil response to high frequencies.

DESCRIPTION OF THE DRAWINGS

In the drawings which illustrate preferred embodiments of the invention.

DETAILED DESCRIPTION

Figure 2:
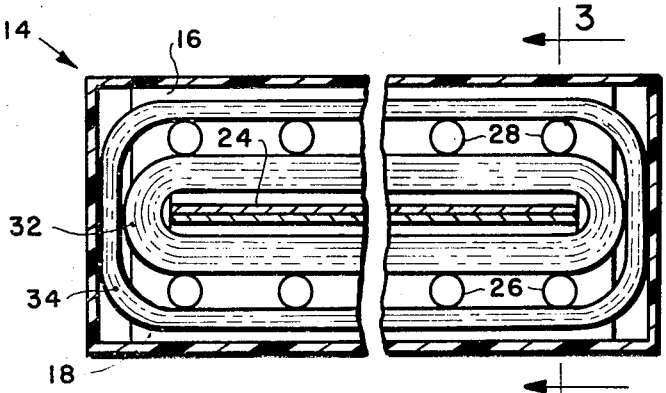
FIG. 2 is a sectional plan view of a preferred embodiment of the pickup.

It will be noted at the outset that the elongated concentric coils in each embodiment of the pickup are symmetrical about a central plane. Sectional plan views of FIGS. 2, 7 and 11 show a single coil divided into two sections comprising a central sensing coil in the magnetic flux field and an outer humbucking coil, both coils being symmetrical about vertical planes in both the longitudinal and lateral, or X and Y directions. Similarly, the sectional elevation views of FIGS. 3, 5, 6 and 10 show the central sensing coils and the outer humbucking coils being coplanar or in closely spaced parallel planes parallel with the plane of the instrument strings. Such a coil configuration renders the pickup substantially insensitive to extraneous electromagnetic radiation emanating from any direction.

Figure 1:
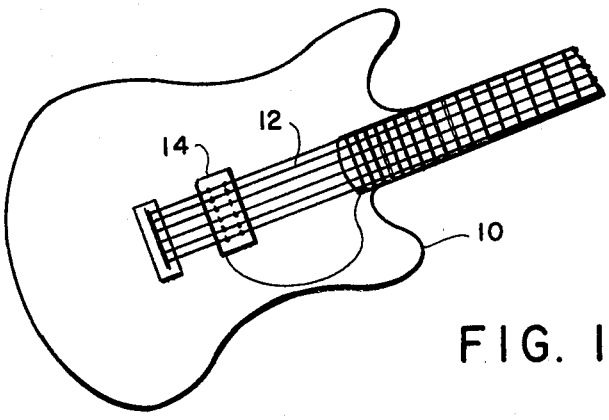
FIG. 1 is a plan view of a portion of an electric guitar illustrating a typical position of the electromagnetic pickup.

Turning now to a description of the preferred embodiments, FIG. 1 is a plan view of a section of an electric guitar 10 equipped with ferromagnetic strings 12 overlying an electromagnetic pickup 14 that may be pemanently mounted to the surface of the guitar 10 with its longitudinal axis normal to the axis of the strings 12. It should be pointed out that the electromagnetic pickup of the invention may be built to be used with any type of instrument having ferromagnetic strings, such as an acoustic guitar, banjo, etc.

Figure 3:
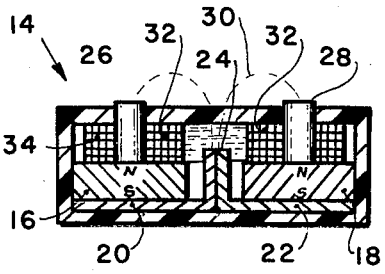
FIG. 3 is a sectional end view of the pickup of FIG. 2.

FIG. 2 is a sectional plan view of the preferred embodiment of the electromagnetic pickup 14 and FIG. 3 is a sectional end elevation view taken along the lines 3—3 of FIG. 2. Pickup 14 includes two separate magnetic flux sources 16 and 18 which are preferably thin, flat rubber or flexible magnets, such as a Plastiform TM brand permanent magnet manufactured by 3-M Corporation. The magnets 16 and 18 are identically polarized on the flat surfaces and, for example, the top flat surface of both magnets 16 and 18 may be polarized with a north magnetic pole and the bottom or opposite surfaces may be oppositely polarized with a south pole. The length of the magnet must be sufficiently long to span the total width of the strings 12 and in a standard 6-string guitar, the magnets 16 and 18 may be approximately 60 millimeters long, 25 millimeters wide and approximately 6 millimeters in thickness. Magnets 16 and 18 are parallel and spaced approximately 6 millimeters and the lower south polar surfaces of each magnet are magnetically coupled together. Underlying the south polar surface of the magnet 16 is one leg of an angle member 20 and underlying the magnet 18 is a leg of a second angle member 22. Both angle members 20 and 22 are in close contact, as illustrated in FIG. 3, to magnetically interconnect the bottom surfaces of the magnets 16 and 18. Arising in a vertical plane midway between magnets 16 and 18 are the vertical legs of the angle members 20 and 22 and the upper surface of these legs form a south pole piece or flux return 24. It is apparent that the angle members 20 and 22 may be formed from an inverted ferromagnetic T-section instead of the pair of angles.

Centrally positioned on the top or north polar surface of each of the magnets 16 and 18 are pole pieces 26 and 28. Pole pieces 26 and 28 are ferromagnetic and are preferably cylindrical in shape. The bottom surface of the pole pieces are magnetically coupled to the north polar surface of the magnet 16 or 18 and the top surface of the magnets 26 and 28 are in the vicinity of the ferromagnetic strings of the guitar so that the flux path may emanate from the top surface of each of the magnets 16 and 18 and be conductive through their respective pole pieces 26 and 28, through strings 12 and back to the flux return or south pole piece 24 as indicated by the dashed lines 30.

Figure 4:
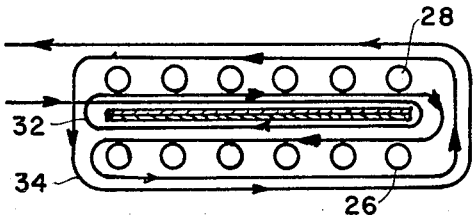
FIG. 4 is an electrical schematic illustrating the winding of the sensing coils in the pickup of FIGS. 2 and 3.

Positioned within the influence of the flux path 30 is a sensing coil 32 which may comprise approximately 3,000 turns of No. 43 AWG copper magnet wire. Sensing coil 32 is symmetrically wound about the central vertical plane of the pickup 14 and overlies the top adjacent surfaces of the magnets 16 and 18. Overlying the outer or remote top surfaces of the magnets 16 and 18 and exterior of the pole pieces 26 and 28, and therefore out of the influence of the magnetic flux path 30, is the humbucking coil 34. As illustrated in FIG. 4, sensing coil 32 and humbucking coil 34 are in series but are wound in opposite directions. Thus, as illustrated in FIG. 4, the sensing coil 32 may be wound in a clockwise direction whereas the humbucking coil 34 is concentrically wound in a counter-clockwise direction around the periphery of the sensing coil so that the maximum width of the humbucking coil 34 is greater than the exterior width of the sensing coil 32.

The humbucking coil 34 may also be wound with No. 43 AWG copper magnet wire. However, there are fewer turns on coil 34 than on the sensing coil 32. For example, if the sensing coil 32 contains 3,000 turns, it has been found that all extraneous electromagnetic radiation resulting in hum can be eliminated from the pickup with a humbucking coil 34 containing approximately 1,000 turns. The precise number of turns in the humbucking winding 34 may be very accurately determined experimentally during construction of the pickup by connecting the output terminal of the pickup to an amplifying system and then adjusting the number of turns in the humbucking coil 34 for a minimum or hum-free output. By using this process, it will be found that at one point the number of turns on the humbucking coil will completely eliminate all extraneous hum with maximum amplification, and because the sensing coil 32 and humbucking coil 34 are concentric and closely spaced and symmetrical about a central vertical plane, the complete humbucking will be effectual at virtually any angle of the pickup with respect to the source of the hum.

The flux return or south polar piece 24 is illustrated in FIG. 3 as partially extending up between the pickup coil 32. The height of the flux return 24 should only be sufficient to assure that the magnetic flux returns to that pole piece. Since the material comprising the flux return 24 is ferromagnetic, its height within the sensing coil 22 will affect and vary the inductance of that coil and hence the high frequency response of the pickup. It is therefore most desirable for high frequency response to keep the flux return member 24 well below the top surface of the pickup and preferably below the bottom plane of the coil 32. If, however, high frequency response is not a factor, the flux return member 24 may extend as high as desired and up to the level of the top surfaces of the north polar pieces 26 and 28.

Figure 5:
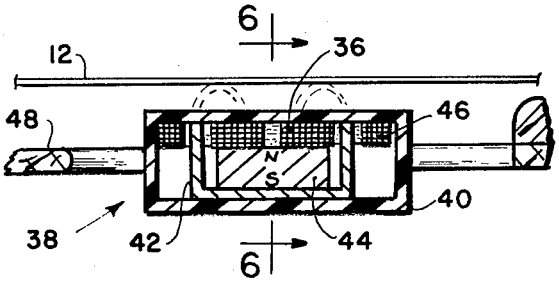
FIG. 5 is a sectional end view of a second embodiment of the pickup without central pole pieces.

FIG. 5 is a sectional end elevation view illustrating another embodiment of the pickup having a relatively low impedance and low "Q" sensing coil 36 for generating signals over a wide frequency range, and particularly into the high musical notes. This pickup 38 includes a plastic housing 40 containing a ferromagnetic U-shaped member 42 attached to the inner floor of the housing 40. Centrally positioned within the member 42 and magnetically coupled to the floor of the member 42 is a magnet 44 similar to the magnets 16 or 18 of FIG. 3. The side walls of the U-shaped member 42 preferably extend up to the internal ceiling of the housing 40 and each constitutes a south pole piece for the conduction of magnetic flux from the south pole of the magnet 44 and up through the instrument strings 12 and back to the north polar surface of the magnet. Overlying the top surface of the magnet 44 is the sensing coil 36 which may be similar in all respects to the coil 32 of FIGS. 2 and 3. It will be noted that the embodiment illustrated in FIGS. 5 and 6 contains no cylindrical north pole pieces so that the total width of the sensing coil 36 may be very small.

Figure 6:
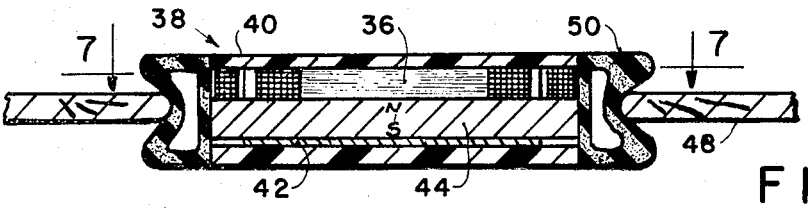
FIG. 6 is a sectional side elevational view of the pickup taken along the lines 6—6 of FIG. 5 and illustrates a resilient means for installing the pickup in the soundboard hole of an acoustic guitar.
Figure 7:
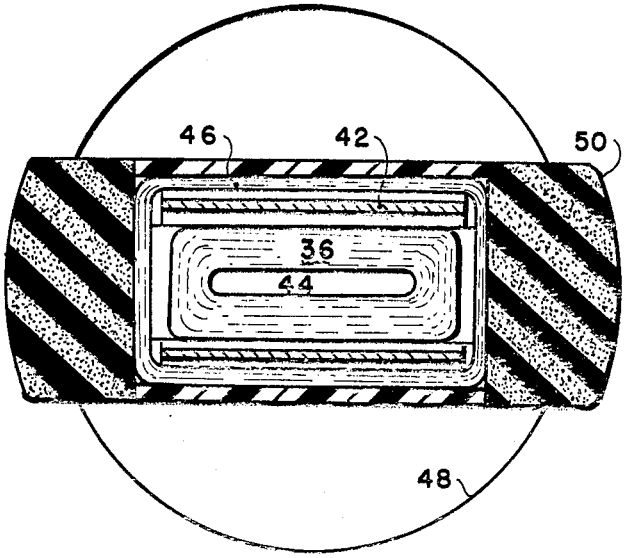
FIG. 7 is a sectional plan view taken along the lines 7—7 of FIG. 6.
Figure 8:
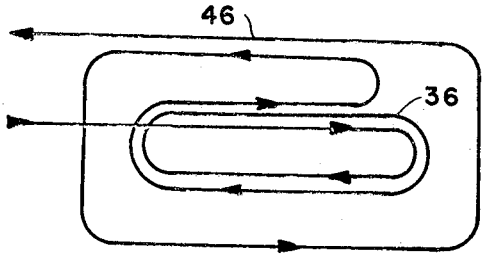
FIG. 8 is a schematic drawing of the sensing and humbucking coil in the pickup of FIG. 7.

As with the previously described pickup, the embodiment illustrated in FIGS. 5 and 6 includes a humbucking coil 46 concentrically wound around the sensing coil 36 but outside of the magnetic flux path passing through the ferromagnetic instrument strings 12 and magnetically shielded therefrom by the side walls of the U-shaped member 42. As illustrated in the schematic diagram of FIG. 8, the humbucking coil 46 is wound in series with the sensing coil 36 but wound in opposite directions within the pickup housing 40. In the embodiment of FIG. 5 it has been found that the number of turns on the humbucking coil 46 should be in the order of one-half the number on the sensing coil 36 for a complete hum cancellation by the pickup.

The pickup 38 illustrated in FIGS. 5, 6 and 7 is shown mounted within the soundboard hole of an acoustic guitar 48. As best illustrated in FIGS. 6 and 7, a resilient or sponge rubber cushion 50 is cemented to the end surfaces of the housing 40 and is of sufficient size to extend the length of the housing so that when compressed as illustrated in FIG. 6, the pickup will snugly fit in the soundboard hole. The electromagnetic pickup may therefore be quickly inserted or removed by the musician or may be tilted at an angle with respect to the axis of the instrument strings to obtain unusual musical effects.

Figure 9:
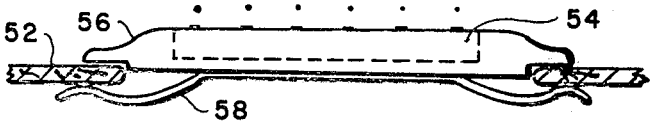
FIG. 9 is a sectional side elevation view illustrating a second method for installing the pickup in the soundboard hole of a guitar.

FIG. 9 is a side elevation view illustrating an alternate method for attaching the pickup to the soundboard hole of a guitar 52, or similar instrument. In this embodiment, the pickup 54 is mounted within an ornamental housing 56 such as, for example, a polished hardwood housing. The bottom surface of the housing 56 may have a recessed rim so that the housing looks loosely within the soundboard hole and a resilient clip 58 of a paramagnetic or diamagnetic material such as aluminum, plastic, brass, etc., is attached to the bottom of the housing 56 and permits the housing to be rapidly and firmly attached or removed from the soundboard hole of the guitar 52.

Figure 10:
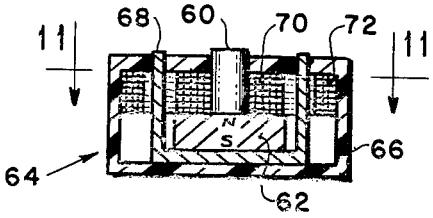
FIG. 10 is a sectional end elevational view of a third embodiment of the pickup of the invention.
Figure 11:
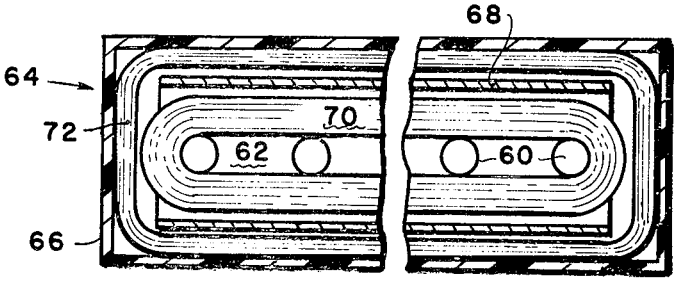
FIG. 11 is a sectional plan view taken along the lines 11—11 of FIG. 10.

FIG. 10 is an end elevation view of a third embodiment of the invention which is substantially identical with the embodiment illustrated in FIG. 5 but which includes cylindrical ferromagnetic pole pieces centrally positioned and magnetically coupled to the north pole surface of the flat plate magnet 62. As with the embodiment illustrated in FIG. 5, the pickup 64 illustrated in FIGS. 10 and 11 include a rectangular housing 66 containing the U-shaped ferromagnetic member 68 magnetically coupled to the south polar surface of the magnet 62 and extending up to or through the top surface of the housing 66. The magnet 62 is centrally positioned in the member 68 and a sensing coil 70 overlies the top surface of the magnet and is wound around the north pole pieces 60. Magnetic flux produced by the magnet 60 therefore is conducted through the south pole piece channel member 68, through the ferromagnetic strings of the musical instrument and to the north magnetic pole piece 60. A humbucking coil 72 is concentrically wound around the sensing coil 70 and the exterior surface of the channel member 68 and is therefore shielded from the magnetic flux path. In this embodiment, humbucking coil 72 has approximately one-half the number of turns of the sensing coil 70 but as with the previous embodiments, complete hum cancellation can best be assured by experimentation.

In the embodiments illustrated in FIGS. 10 and 11, the presence of ferromagnetic pole pieces 60 in the center of sensing coil 70 acts as an iron core to that coil and materially increases the inductance and "Q" of the coil. The presence of the pole pieces 60, however, acts to improve the magnetic flux path focused to each of the strings overlying each pole piece and thereby increases the sensitivity of the pickup to a relatively narrow band width of frequencies when compared with the low impedance wide band response of the pickup 38 of FIGS. 5, 6 and 7.

Having thus described my invention, what is claimed is:

1. A humbucking electromagnetic pickup for musical instruments having ferromagnetic strings, said pickup comprising:

magnetic means for generating a magnetic flux path through the ferromagnetic strings of a musical instrument;

a sensing coil positioned in said flux path for generating output signals corresponding to flux variations produced by vibration of said strings; and a humbucking coil in series with said sensing coil but wound in an opposite direction thereto, said humbucking coil being concentric with said sensing coil and having a greater inside dimension than the outside dimension of said sensing coil.

2. The pickup claimed in claim 1 wherein said sensing coil and said humbucking coil are symmetrical about a vertical longitudinal plane and about a vertical lateral plane.

3. The pickup claimed in claim 1 wherein said humbucking coil is wound around the periphery of said sensing coil and is substantially coplanar with said sensing coil.

4. The pickup claimed in claim 3 wherein said magnetic means includes two spaced parallel permanent magnets identically polarized on their top surfaces, and second magnetic means interposed in the space between said magnets for conducting magnetic flux at the polarity of the identically polarized bottom surfaces to points between said top surfaces.

5. The pickup claimed in claim 4 further including a plurality of pole pieces magnetically coupled to the top surface of each of said two magnets, each of said plurality of pole pieces being vertically positioned beneath an instrument string for conducting magnetic flux to that string.

6. The pickup claimed in claim 5 wherein said sensing coil overlies the top surfaces of each of said two magnets and between the pluraity of said pole pieces on each of said magnets, and wherein said humbucking coil is wound around each plurality of pole pieces.

7. The pickup claimed in claim 3 wherein said magnetic means is a permanent magnet oppositely polarized on top and bottom surfaces, the bottom surface being spaced further from said string and being magnetically coupled to a second flux conducting member extending toward said strings.

8. The pickup claimed in claim 7 wherein said second flux conducting member is U-shaped, and wherein the bottom surface of said magnet is positioned in and magnetically coupled to the bottom surface of said second flux conducting member.

9. The pickup claimed in claim 8 wherein said sensing coil overlies the top surface of said magnet and wherein said series, oppositely wound, humbucking coil is wound around the exterior of said U-shaped member.

10. The pickup claimed in claim 9 further including a plurality of pole pieces magnetically coupled to the top surface of said magnet and positioned in the windings of said sensing coil, each of said plurality being vertically positioned beneath an instrument string for conducting magnetic flux to its respective string.

11. The pickup claimed in claim 3 wherein said pickup is contained in a housing having at each end a resilient cushion of a length suitable for resiliently mounting said pickup in a soundboard hole underlying the strings of a musical instrument.

12. The pickup claimed in claim 3 wherein said pickup is contained in a housing having a non-ferromagnetic clip on the external lower surface for attaching said pickup to the edge of the soundboard hole underlying the strings of the musical instrument.

13. The pickup claimed in claim 3 wherein said magnetic means includes at least one thin flat flexible magnet.

14. A humbucking electromagnetic pickup for use with musical instruments having ferromagnetic strings, said pickup comprising:

a sensing coil for generating output signals in response to variations in a magnetic flux path through said sensing coil;

a humbucking coil in series with said sensing coil but with windings wound in electrical opposition thereto, said humbucking coil being concentric with said sensing coil and having its inside width surface closely spaced from the outside width surface of said sensing coil;

first magnetic means of a first magnetic polarity for directing a magnetic flux path through the center of said sensing coil; and second magnetic means interposed in the spaces between the outside width surface of said sensing coil and the inside width surfaces of said humbucking coil, said second magnetic means being of a second magnetic polarity for directing said magnetic flux path from the center of said sensing coil across said sensing coil to said second magnetic means.

15. The pickup claimed in claim 14 wherein said first magnetic means is a ferromagnetic pole piece coupled to the first surface of a permanent magnet having oppositely polarized first and second surfaces, said magnet being positioned beneath said sensing coil, and said second magnetic means comprise ferromagnetic pole pieces coupled to the second surface of said permanent magnet.

* * * * *